US010179338B2

(12) United States Patent
Dau et al.

(10) Patent No.: US 10,179,338 B2
(45) Date of Patent: Jan. 15, 2019

(54) ELECTROSTATIC ATOMIZER, AND METHOD FOR ELECTROSTATICALLY ATOMIZING BY USE OF THE SAME

(75) Inventors: Van Thanh Dau, Takarazuka (JP); Tibor Terebessy, Wallingford (GB)

(73) Assignee: SUMITOMO CHEMICAL COMPANY, LIMITED, Tokyo (JP)

( * ) Notice: Subject to any disclaimer, the term of this patent is extended or adjusted under 35 U.S.C. 154(b) by 197 days.

(21) Appl. No.: 14/235,141

(22) PCT Filed: Jun. 22, 2012

(86) PCT No.: PCT/JP2012/066630
§ 371 (c)(1),
(2), (4) Date: Jan. 27, 2014

(87) PCT Pub. No.: WO2013/018477
PCT Pub. Date: Feb. 7, 2013

(65) Prior Publication Data

US 2014/0151471 A1 Jun. 5, 2014

(30) Foreign Application Priority Data

Jul. 29, 2011 (JP) ..... 2011-166816

(51) Int. Cl.
*B05B 5/053* (2006.01)
*B05B 5/057* (2006.01)
(Continued)

(52) U.S. Cl.
CPC ..... *B05B 5/0533* (2013.01); *B05B 5/0255* (2013.01); *B05B 5/057* (2013.01); *B05B 12/081* (2013.01); *B05B 12/12* (2013.01)

(58) Field of Classification Search
CPC ..... B05B 5/025; B05B 5/0533; B05B 5/1691; B05B 5/0255; B05B 12/081; B05B 12/12;
(Continued)

(56) References Cited

U.S. PATENT DOCUMENTS 2,767,359 A * 10/1956 Larsen ..... B03C 3/68 331/168
3,735,925 A 5/1973 Benedek et al.
(Continued)

FOREIGN PATENT DOCUMENTS

EP 0 887 658 A1 12/1998
GB 0 612 019 11/1948
(Continued)

OTHER PUBLICATIONS

Office Action issued in Japanese Patent Application No. 2011-166816 dated Feb. 24, 2015.
(Continued)

*Primary Examiner* — Alexander Valvis
*Assistant Examiner* — Christopher R Dandridge
(74) *Attorney, Agent, or Firm* — Foley & Lardner LLP

(57) ABSTRACT

An object of the present invention is to provide an electrostatic atomizer variable in arrangement and configuration while being low in cost and uncomplicated. An electrostatic atomizer includes a spray site, a spray electrode (1) electrically connectable to the spray site, a reference electrode (2), and a power supply (4) for applying a voltage between the spray electrode (1) and the reference electrode (2). The reference electrode (2) is arranged such that when a voltage is applied between the spray electrode (1) and the reference electrode (2), matter to be electrostatically atomized is atomized from the spray site. The power supply (4) monitors an electrical property of the spray site, and adjusts the voltage to be applied between the spray electrode (1) and the reference electrode (2) according to a monitored electrical property of the spray site and a predetermined characteristic. The spray electrode (1) and the reference electrode (2) are arranged such that an electrical charge of the matter to be atomized from the spray site is counterbalanced by produc-
(Continued)

tion of at least equal amount of opposite electrical charge at the reference electrode (2).

12 Claims, 5 Drawing Sheets

(51) Int. Cl.
*B05B 5/025* (2006.01)
*B05B 12/08* (2006.01)
*B05B 12/12* (2006.01)

(58) Field of Classification Search
CPC . B05B 5/057; B05B 5/10; H02M 3/28; B03C 3/68
USPC ..... 239/690, 692, 3, 706, 703
See application file for complete search history.

(56) References Cited

U.S. PATENT DOCUMENTS

| | | | | |
|---|---|---|---|---|
| 4,801,086 | A | 1/1989 | Noakes | |
| 4,817,822 | A | 4/1989 | Rand et al. | |
| 5,627,522 | A | 5/1997 | Walker et al. | |
| 6,302,331 | B1 | 10/2001 | Dvorsky et al. | |
| 6,796,303 | B2 | 9/2004 | Zimlich, Jr. et al. | |
| 7,150,412 | B2 | 12/2006 | Wang et al. | |
| 7,337,993 | B2 * | 3/2008 | Pirrie | A61L 9/14 128/200.12 |
| 2006/0214027 | A1 | 9/2006 | Micheli | |
| 2008/0096182 | A1 | 4/2008 | Fulton | |
| 2008/0130189 | A1 | 6/2008 | Kobayashi et al. | |
| 2009/0001200 | A1 | 1/2009 | Imahori et al. | |
| 2009/0134249 | A1 | 5/2009 | Uratani et al. | |
| 2009/0179093 | A1 | 7/2009 | Wada et al. | |
| 2010/0155496 | A1 * | 6/2010 | Stark | B05B 5/0255 239/3 |
| 2013/0192044 | A1 | 8/2013 | Fulton | |

FOREIGN PATENT DOCUMENTS

| | | | | | |
|---|---|---|---|---|---|
| JP | 2010-137126 | A | | 6/2010 | |
| TW | 200815105 | | | 4/2008 | |
| WO | WO 94/12285 | | | 6/1994 | |
| WO | WO09412285 | | * | 6/1994 | B05B 5/025 |
| WO | WO03000431 | | * | 1/2003 | B05B 5/025 |
| WO | WO 2005/097339 | A1 | | 10/2005 | |
| WO | WO2007/144649 | | * | 12/2007 | H02M 3/28 |
| WO | WO 2007/144649 | A | | 12/2007 | |
| WO | WO2007144649 | | * | 12/2007 | B05B 5/053 |
| WO | WO 2008/072770 | A1 | | 6/2008 | |
| WO | WO 2008/142393 | A1 | | 11/2008 | |

OTHER PUBLICATIONS

Office Action issued in Chinese Application No. 201280037226.8 dated Aug. 5, 2015 with English translation.
International Preliminary Report on Patentability of PCT Application No. PCT/JP2012/066630 dated Feb. 13, 2014.
International Search Report and Written Opinion issued in related International Patent Application No. PCT/JP2012/066630, dated Sep. 21, 2012.
Patent Examination Report No. 1 issued in Australian Patent Application No. 2012291395 dated Aug. 15, 2016.
Office Action issued in corresponding Russian application No. 2014104580 dated Feb. 2, 2016 with an English translation.
Office Action dated Mar. 6, 2017 in corresponding Australian Patent Application No. 2012291395.
Office Action dated Jan. 19, 2017 in corresponding Taiwanese Patent Application No. 101125086.
Office Action dated Aug. 9, 2017 in corresponding Taiwanese Patent Application No. 101125086.
The Korean Intellectual Property Office, "Notice of Grounds for Rejection," issued in connection with Korean Patent Application No. 10-2014-7003462, dated Jun. 21, 2018.
European Office Action dated May 2, 2018 in corresponding application No. 12735343.1.
Taiwanese Office Action dated Apr. 24, 2018 in corresponding application No. 101125086.

* cited by examiner

ELECTROSTATIC ATOMIZER, AND METHOD FOR ELECTROSTATICALLY ATOMIZING BY USE OF THE SAME

TECHNICAL FIELD

The present invention relates to electrostatic atomizers and methods for using electrostatic atomizers. In particular, but not exclusively, it relates to electrostatic atomizers having a power supply for supplying electrical power for electrostatic atomization.

BACKGROUND ART

Electrostatic atomization is a technique for dispersing matter, often as a fine plume of droplets from a liquid, by subjecting the matter to be atomized to a suitable electric field. A voltage is applied between an electrode proximal to the matter to be atomized (the spray electrode) and at least one other electrode in the vicinity of the spray electrode. Under suitable conditions, liquid in the electric field is broken up into a spray of substantially monodisperse particles. When a liquid meniscus is subject to such an electric field, the meniscus distorts into a Taylor cone from which a stream of droplets is emitted.

Common forms of electrostatic atomization in the art include so-called "point-to-plane" electrostatic atomization, where a target object to be atomized is charged to the opposite polarity of the liquid and becomes the counter-electrode or the discharge electrode itself. This configuration, exemplified in U.S. Pat. No. 7,150,412, allows all or the majority of liquid being atomized to arrive at and to coat the target as electrostatically atomized charged droplets follow the path of the electric field created between these two electrodes. Following the same principle, the target to be atomized may instead be earthed or grounded as disclosed in U.S. Pat. Nos. 4,801,086 and 3,735,925.

Alternatively, a configuration may comprise three or more electrodes so arranged that an electric field is created in between two or more electrodes within the spray device itself. Whilst there is some partial discharge of the liquid being atomized due to the proximity of a counter-electrode, the majority of charged droplets will leave the device and arrive at a non-predetermined target, for example in U.S. Pat. No. 6,302,331.

The size, charge and flow rate of droplets atomized from an electrostatic atomizer are in part determined by the physical properties of the material to be atomized and also the electric field strength at the site of atomizing. When material to be atomized, particularly a liquid, possesses appropriate physical properties of conductivity, viscosity and surface tension, a spray of particles with a substantially uniform distribution of charge and size may be achieved for a particular electric field present between the first and second electrodes. The particular electric field is typically achieved by applying a particular voltage between the first and second electrodes.

Since the electric field varies with electrode geometry, amongst other factors, the particular voltage will be dependent on the separation of the electrodes (i.e., the distance between the point of emanation of material from the spray device, which may be a spray electrode) and the second electrode (reference electrode). When, for example, a liquid composition is formulated to possess appropriate physical properties, the particular voltage may be required to be adapted to compensate for variation in the geometrical arrangement of spray electrode and the reference electrode, for example due to variation within manufacturing tolerances.

Alternatively, where there is variation in manufacturing tolerances of the liquid to be atomized such as may arise in batch-to-batch variation of the physical properties of the liquid, or in batch-to-batch variation of the physical properties of various kinds of drug raw materials, the particular voltage may require adapting in order to achieve a suitable spray.

It is desirable therefore to be able to monitor the conditions and performance of any electrostatic atomizer in order to achieve a suitable output of material from the device notwithstanding variation in geometrical arrangement of spray components, differences between formulation and batches of material to be atomized and changes in environmental conditions, which may affect properties of the matter to be atomized.

Further, regarding the spray of material, where an electrostatic atomizer comprises a reservoir for storing and delivering material to the site of spray, it is desirable to be able to determine the level of material in the reservoir and particularly so when the reservoir is empty or substantially empty. In this way, a user of the device can find a timing at which it is necessary to provide a replacement reservoir and energy is not wasted in attempting to spray material when there is nothing left to be atomized.

In respect of these needs to monitor spray conditions, a number of solutions have been disclosed in the art. For example, the device of WO2005/097339 provides a device comprising voltage- and current-monitoring circuits which monitor voltage applied to and current flowing between an emitter (or spray) electrode and a discharging "opposed" electrode. The device disclosed in US2009/0134249, measures discharge current between an atomizer electrode and counter electrode in order to establish that a suitable voltage has been applied between the electrodes for water condensate on the atomizer electrode to be dispersed by electrostatic atomization. The power supply of WO2007/144649 monitors the discharging current flowing through the first and second electrodes of the device and adapting the voltage applied between the electrodes in response. The electrostatic atomizer of WO2008/072770 monitors voltage "upstream" of the atomizer electrodes by virtue of an adaptation to a self-oscillation type DC/DC convertor.

These and other means for monitoring current and adapting the spray condition in response to variations in devices or ambient environmental conditions suffer from a disadvantage in that they detect discharge current between a first electrode (which is usually a spray electrode) and a second electrode (which is usually a discharge electrode) by measuring the current at the discharge electrode. In such cases it is necessary, that all, or a proportion of, the particles generated at the spray electrode are directed by an electric field applied between the electrodes towards the discharge electrode. In some cases, one or more addition electrodes or other means are employed to direct atomized particles such that the majority do not contaminate the discharge electrode and to avoid excessive wastage of material.

Inferential monitoring of electrostatic atomization by measurement of discharge current on the discharge electrode is inaccurate insofar as such monitoring relies on assumptions regarding the representative amount of charged material issued at the electrostatic spray site which reaches the discharge electrode. This amount is susceptible to, amongst other things, variations in device geometry, whether or not the matter to be atomized is present, the physical properties of the matter to be atomized, and ambient environmental conditions.

On the other hand, measurement of current flowing at the spray electrode would reflect the accurate value of current carried away by the charged particles, however it is impracticable for electrostatic atomizers as it would require accurate detection of very low current levels (1-100 μA typically drawn by the high voltage spray electrode) carried on a high voltage signal (typically several kV).

Often, a reservoir comprising material to be atomized is hidden from the user of an electrostatic atomizer and it is not immediately obvious as to the fill level of the reservoir, particularly if the electrostatic atomizer has been in use for some time. Various devices and methods for detecting, monitoring or measuring the level of a liquid, whether or not relating to an electrostatic atomizer, are known in the art. For example, in U.S. Pat. No. 5,627,522, the level of liquid in a reservoir is sensed by periodically lowering a pipette probe into the liquid and detecting a change in capacitance between the probe in the liquid and a probe in the air. Another known method is disclosed in EP 0887658, where the phase shift of electromagnetic waves reflected of the surface of liquid in a reservoir is compared to a reference, thereby providing information about the level of liquid left therein. The fill level of a reservoir may be inferred by counting doses such as disclosed in U.S. Pat. No. 6,796,303, until a preset number of doses have been reached and the device indicates an empty vessel. Such a system is unsuitable where the dose amount varies according to variations in performance of the device, for example due to changes in ambient environmental conditions. A similar technique is disclosed in U.S. Pat. No. 4,817,822. Another indirect method of monitoring the reservoir can be by the use of a flow measuring device. For example in WO 2008/142393 A1, such a device measures the pressure drop between a pair of spaced apart pressure sensors.

CITATION LIST

Patent Literatures

Patent Literature 1
U.S. Pat. No. 7,150,412
Patent Literature 2
U.S. Pat. No. 4,801,086
Patent Literature 3
U.S. Pat. No. 3,735,925
Patent Literature 4
U.S. Pat. No. 6,302,331
Patent Literature 5
International Publication No. WO 2005/097339
Patent Literature 6
United States Patent Application Publication No. 2009/0134249
Patent Literature 7
International Publication No. WO 2007/144649
Patent Literature 8
International Publication No. WO 2008/072770
Patent Literature 9
U.S. Pat. No. 5,627,522
Patent Literature 10
European Patent No. 0887658
Patent Literature 11
U.S. Pat. No. 6,796,303
Patent Literature 12
U.S. Pat. No. 4,817,822
Patent Literature 13
International Publication No. WO 2008/142393 A1

SUMMARY OF INVENTION

Technical Problem

The above techniques are all unsatisfactory in that they require additional electronic or mechanical components which, with their associated complexity, power consumption make them generally unsuited to mass manufacture especially for consumer or low-cost business markets and vulnerable to points of failure or contamination during manufacture or in use.

The present invention was made in view of the problem, and an object of the present invention is to provide an electrostatic atomizer, with a simple configuration, which is capable of stably emitting, outside the electrostatic atomizer, matter to be electrostatically atomized. Further, a secondary object of the present invention is to provide, for example, an electrostatic atomizer which is capable of adjusting electrostatic atomization output in accordance with ambient environmental conditions and conditions of electrostatic atomization itself.

Solution to Problem

It is desirable to provide an electrostatic atomizer which is capable of accommodating, at low cost and complexity, geometrical and formulation variance due to relaxed manufacturing tolerances and of adapting electrostatic atomization output in response to ambient environmental conditions and the conditions of electrostatic atomization itself.

In a first aspect of the invention, there is provided an electrostatic atomizer comprising: a spray site for electrostatically atomizing matter by electrically affecting the matter;

a spray electrode electrically connectable to the spray site; a reference electrode being arranged such that when a voltage is applied between the spray electrode and the reference electrode, the matter to be electrostatically atomized is atomized from the spray site; and a power supply applying a voltage between the spray electrode and the reference electrode, monitoring an electrical property of the spray site, and adjusting the voltage to be applied between the spray electrode and the reference electrode according to a monitored electrical property of the spray site, wherein the spray electrode and the reference electrode are further arranged that an electrical charge of the matter to be atomized from the spray site is counterbalanced by at least equal amount of opposite electrical charge at the reference electrode.

Such a counter-balancing of electrical charge provides a charge-balanced electrostatic atomization system. For a charge-balanced system (a system in which electrical charges are counter-balanced), in order to produce a steady flow of electrostatically atomized charged species directed away from the electrostatic atomizer, it is preferable that equal amount of opposite electrical charges be produced by the reference electrode, and used for counter-balance of electrical charges.

The matter to be electrostatically atomized can be one or more kinds of liquids, gases or solids, or a combination thereof.

Typically, the reference electrode is adapted to easily produce particles of opposite charge by ionizing air particles, e.g. by having a well-defined sharp edge or point for generation of a strong electric field in the vicinity of the reference electrode. Oppositely-charged particles released from the spray electrode and reference electrode may partially or entirely discharge each other, however this aspect is not relevant from the point of view of the electrostatic atomizer. A part of charged particles generated at the spray site reaches the referenced electrode, and is discharged by the reference electrode. This is a principle of the charge-balanced system. In this case, only charged particles not reaching the reference electrode will be counter-balanced with ionized air particles of opposite charge. For power-efficient production of charged particles, however, it is desirable to ensure that partial discharging of particles at the reference electrode does not take place.

A charge-balanced system can be achieved, when a device is isolated or floating, i.e. electrically not connected to a large reservoir of charge such as mains power. For a battery operated device, the charge balance will be attained, as the whole device is isolated. For a mains operated device, it is important to ensure (e.g. via sufficient electrical isolation) that the net charge flow to the mains outlet is zero.

For a charge-balanced system, the type of particle charge is not relevant, since the device can equally well produce positively charged particles counterbalanced with negative air ions as well as negatively charged particles counterbalanced with positive air ions, depending on the polarity of the high voltage applied. Typically, however, the electric field needs to be adapted by applying a suitable voltage or changing the electrode and/or dielectric geometry for efficient charge balanced operation of oppositely charged particles.

The charge balance principle of the atomizer according to the first aspect has many advantages. Since the spray current is mirrored by the release of oppositely charged ions, precise measurement of spray current is possible at the reference electrode. Also, the number of charged particles produced by electrostatic atomization can be limited with a suitably shaped reference electrode, as the system can only produce as many electrostatically atomized charged particles, as it can be counterbalanced by the reference electrode, resulting in stable electrostatic atomization. Because the current at the reference electrode represents the total current released by the spray electrode, it is important to ensure that charge loss, due to factors other than electrostatic atomization, is kept to minimum at the spray electrode. Charge loss can take place e.g. via electrochemical reaction at the spray electrode.

In a second aspect of the present invention, there is provided an electrostatic atomizer comprising: a first spray site and a second spray site from each of which matter is to be atomized; a first electrode electrically connected to the first spray site; a second electrode electrically connected to the second spray site; and a power supply for applying a voltage between the first electrode and the second electrode, the first spray site and the second spray site being arranged to, during atomization, electrically affect the matter to be atomized, which is stored in respective first and second reservoirs, when a voltage is applied between the first electrode and the second electrode, the matter stored in the first reservoir being atomized from the first spray site, and the matter stored in the second reservoir being atomized from the second spray site, and the first electrode and second electrode being arranged such that an electrical charge of the matter to be atomized from the first spray site or the second spray site is counterbalanced by at least equal amount of opposite electrical charge to be produced at the first spray site or the second spray site, respectively. The power supply monitors an electrical property of the first spray site or the second spray site, and adjusts a first voltage or a second voltage to be applied between the first electrode and the second electrode according to (i) a monitored electrical property of the first spray site or the second spray site and (ii) a predetermined characteristic. In a preferred embodiment, the power supply monitors current at the first spray site or the second spray site by measuring current at the first electrode or the second electrode, respectively.

In a third aspect of the invention, there is provided an electrostatic atomizer comprising a spray site for atomizing matter, and, during atomization, electrically affecting matter to be electrostatically atomized; a spray electrode electrically connected to the spray site; a reference electrode being arranged such that when a voltage is applied between the spray electrode and the reference electrode, the matter to be electrostatically atomized is atomized from the spray site; and a power supply for applying a voltage between the spray electrode and the reference electrode, indirectly monitoring spray current at the spray site, and detecting when the spray current drops below a threshold value, wherein the spray electrode and the reference electrode are further arranged such that an electrical charge of the matter to be atomized from the spray site is counterbalanced by at least equal amount of opposite electrical charge to be produced by the reference electrode.

Accordingly, in the third aspect of the invention, the power supply is adapted to monitor end-of-life, i.e. when the reservoir of liquid is empty. In one embodiment, end-of-life condition is detected by monitoring the spray current by measuring the current at the reference electrode. Based on the charge balance principle, if the spray site does not produce charged particles, the equivalent current on the reference electrode will also drop to zero, which can be detected via the above-mentioned current monitoring circuit. In another embodiment, a separate "monitoring" electrode is immersed in the liquid reservoir and the voltage level is monitored e.g. by measuring the voltage at the junction of two resistors forming a potential divider connected between the monitoring electrode and the reference electrode. With a suitably-shaped monitoring electrode, the voltage level will vary depending on whether the monitoring electrode is in or above the liquid level. In yet another embodiment, the liquid level in the reservoir may be monitored e.g. by an optical sensor or a capacitive sensor.

Advantageous Effects of Invention

An electrostatic atomizer of the present invention is configured to comprise: a spray site for electrostatically atomizing matter by electrically affecting the matter; a spray electrode electrically connectable to the spray site; a reference electrode being arranged such that when a voltage is applied between the spray electrode and the reference electrode, the matter to be electrostatically atomized is atomized from the spray site; and a power supply applying a voltage between the spray electrode and the reference electrode, monitoring an electrical property of the spray site, and adjusting the voltage to be applied between the spray electrode and the reference electrode according to a monitored electrical property of the spray site, wherein the spray electrode and the reference electrode are further arranged that an electrical charge of the matter to be atomized from the spray site is counterbalanced by at least equal amount of opposite electrical charge at the reference electrode.

Further, an electrostatic atomizer of the present invention is configured to comprise: a first spray site and a second spray site from each of which matter is to be atomized; a first electrode electrically connected to the first spray site; a second electrode electrically connected to the second spray site; and a power supply for applying a voltage between the first electrode and the second electrode, the first spray site and the second spray site being arranged to, during atomization, electrically affect the matter to be atomized, which is stored in respective first and second reservoirs, when a voltage is applied between the first electrode and the second electrode, the matter stored in the first reservoir being atomized from the first spray site, and the matter stored in the second reservoir being atomized from the second spray site, and the first electrode and second electrode being arranged such that an electrical charge of the matter to be atomized from the first spray site or the second spray site is counterbalanced by at least equal amount of opposite electrical charge to be produced at the first spray site or the second spray site, respectively.

An electrostatic atomizer of the present invention is configured to comprise: a spray site for atomizing matter, and, during atomization, electrically affecting matter to be electrostatically atomized; a spray electrode electrically connected to the spray site; a reference electrode being arranged such that when a voltage is applied between the spray electrode and the reference electrode, the matter to be electrostatically atomized is atomized from the spray site; and a power supply for applying a voltage between the spray electrode and the reference electrode, indirectly monitoring spray current at the spray site, and detecting when the spray current drops below a threshold value, wherein the spray electrode and the reference electrode are further arranged such that an electrical charge of the matter to be atomized from the spray site is counterbalanced by at least equal amount of opposite electrical charge to be produced by the reference electrode.

BRIEF DESCRIPTION OF DRAWINGS

Embodiments of the invention will now be described with reference to the accompanying drawings.

DESCRIPTION OF EMBODIMENTS

Figure 1:
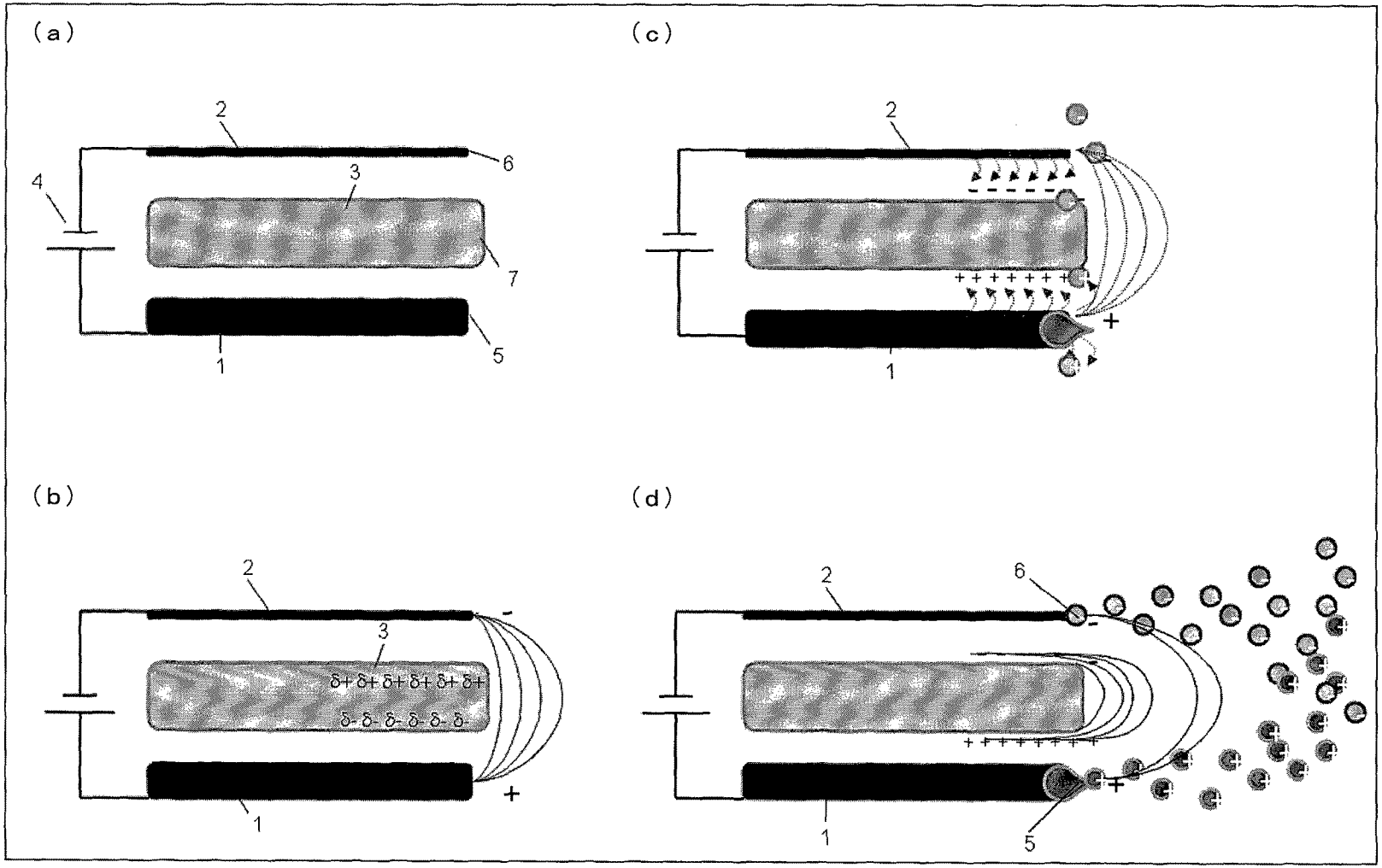
FIG. 1 shows a charge-balanced electrostatic atomizer in accordance with an embodiment of the invention.

FIGS. 1(*a*), 1(*b*), 1(*c*) and 1(*d*) show a first embodiment of an electrostatic atomizer according to the invention. A first electrode 1 and second electrode 2 are separated by a dielectric 3 such that there is no direct line-of-sight between the first electrode 1 and the second electrode 2. The first electrode 1 and the second electrode 2 are operatively connected to a power supply 4. In this embodiment, the first electrode (spray electrode) 1 comprises an electrostatic spray site 5 from which matter (matter to be atomized) is atomized and may be described as a spray electrode 1. The spray electrode 1 is electrically connectable to the electrostatic spray site 5. Similarly, the second electrode 2 may be described as a reference electrode 2, and comprises a tip 6.

FIG. 1(*a*) shows in operation, the power supply 4 provides a high voltage which is applied between the spray electrode 1 and the reference electrode 2. In this example, the spray electrode 1 comprises a conductive conduit such as a metal capillary (i.e., a stainless steel capillary, e.g., a 304 steel capillary), and matter to be atomized, i.e., a suitable liquid. The reference electrode 2 comprises a conductive rod such as a metal pin (a stainless steel pin, e.g., a 304 steel pin). Preferably, the dielectric 3 is non-conductive, i.e., is comprised of non-conductive materials, and comprises a leading edge 7. Suitable materials for the dielectric 3 include nylon, polypropylene. The dielectric 3 is proximal to the spray electrode 1 and the reference electrode 2.

FIG. 1(*b*) shows the electrostatic atomizer when a high voltage, for example between 1 through 30 kV (e.g., 3 through 7 kV), is applied between the spray electrode 1 and the reference electrode 2. In this case, an electric field is established between the electrodes and a dipole is induced in the dielectric 3. In this non-limiting example, the spray electrode 1 is positively-charged and the reference electrode 2 is negatively charged, although the converse is also possible. A negative dipole is established at the surface of the dielectric most proximal to the positive spray electrode 1 and a positive dipole is established at the surface of the dielectric 3 most proximal to the negative second electrode 2. Charged gaseous and matter species are emitted by the spray electrode 1 and the reference electrode 2.

At least electric charges equivalent to electric charges of matter to be atomized from the electrostatic spray site 5 of the spray electrode 1 are generated by the reference electrode 2. The electric charges generated by the reference electrode 2 have a polarity opposite to that of the matter to be atomized. Therefore, the electric charges of the matter to be atomized are counter-balanced with the electric charges generated by the reference electrode 2.

FIG. 1(*c*) shows an example where, positively-charged species arising from the positive spray electrode are deposited on the surface of the dielectric 3 proximal to the spray electrode 1. Similarly, negatively-charged species arising from the negative reference electrode 2 are deposited on the surface (side surface) of the dielectric 3 proximal to the reference electrode 2. As a consequence of this charge deposition, the electric field as shown in FIG. 1(*d*) is reshaped, and positively-charged species arising from the positively-charged spray electrode 1 are repelled away from the electrostatic spray site 5 and the surface of the dielectric 3 proximal to the spray electrode 1 and ultimately away from the electrostatic atomizer. Therefore, the dielectric 3 functions as directing means for directing the matter to be atomized from the electrostatic spray site 5 away from the electrostatic atomizer such that at least a part of electric charge particles do not reach the reference electrode 2.

Charged species arising from the spray electrode typically comprise charged gaseous and particulate species. The charged gaseous species are generated at the spray electrode and the charged particulate species are generated at the electrostatic spray site 5. Similarly, charged species arising from the negatively-charged reference electrode 2 are repelled away from the surface of the dielectric 3 proximal to the reference electrode 2 and ultimately away from the electrostatic atomizer. In this way, there is no or little flow of charged species from one electrode to the other. In this example, the spray electrode 1 and the reference electrode 2 are arranged such that the foci of the electric field established upon application of the high voltage between the electrodes are focused at the electrostatic spray site 5 and the tip 6 of the reference electrode 2.

Usage of the dielectric makes it possible to most costlessly generate the flow of charged particles in a direction away from the electrostatic atomizer. Meanwhile, other means can be employed. For example, the flow of charged particles can be generated in a desired direction by applying a magnetic field by use of a magnetic field generator (directing means) that deflects a motion of the charged particles. Alternatively, for attaining a similar effect, the flow of charged particles can be generated by air flow generated by an air flow generator (air flow generating means) such as a fan. Alternatively, the above techniques can be suitably combined so as to achieve optimal spray performance.

The power supply 4 can periodically change a polarity of the voltage to be applied between the spray electrode 1 and the reference electrode 2 such that matter having a positive electrical charge, and matter having a negative electrical charge are alternately atomized from the spray site 5.

In FIG. 1, a suitably separation between the electrostatic spray site 5 and the tip 6 of the reference electrode 2 is about 8 mm. The electrostatic spray site 5 and the tip 6 of the reference electrode 2 are typically recessed approximately 1 mm behind the leading edge 7 of the dielectric 3. Other conductive materials and shapes are suitable for the electrodes, including metals such as titanium, gold, silver and other metals, and semi-conductive materials are also possible.

Figure 2:
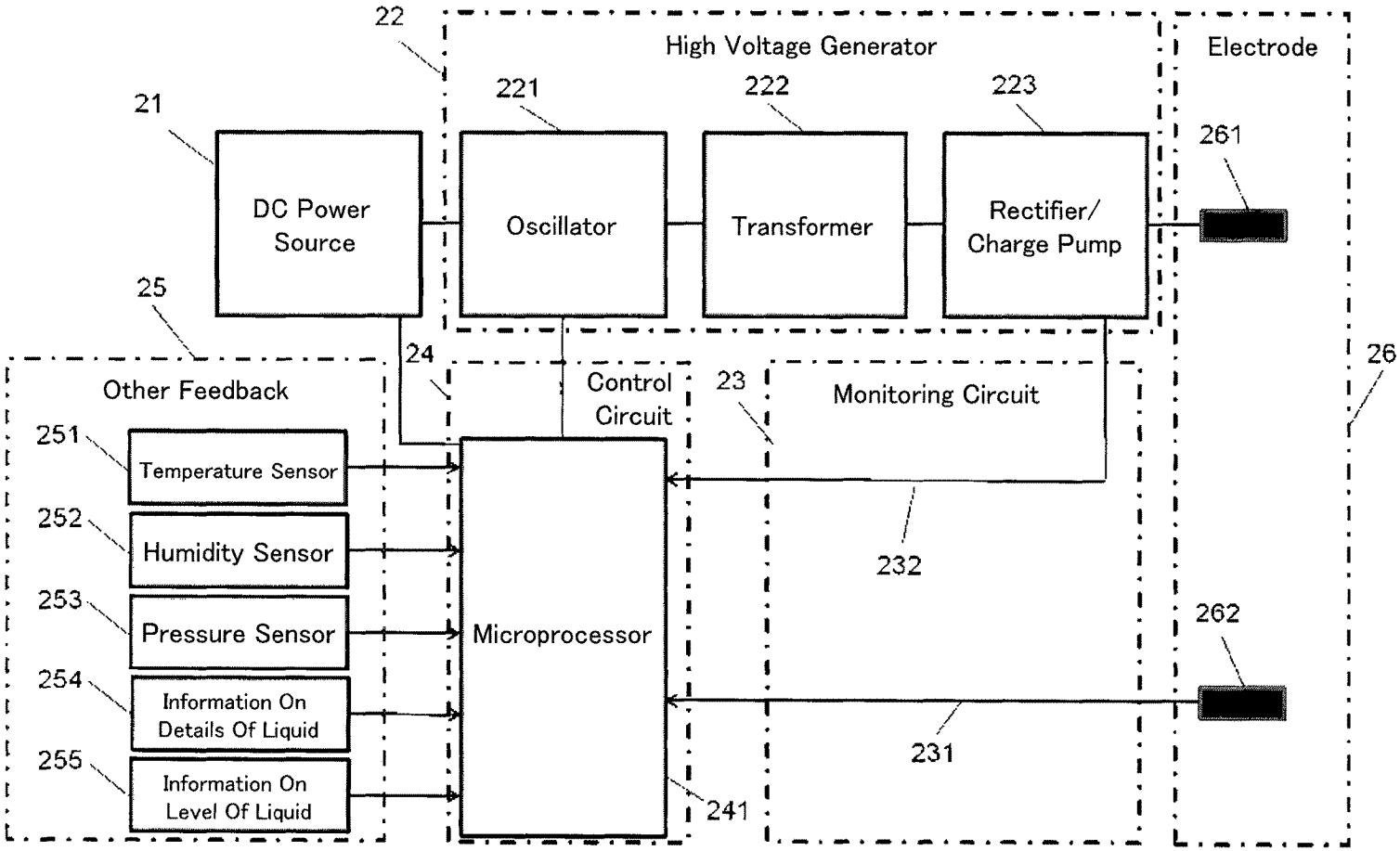
FIG. 2 shows an example of a power supply according to an embodiment of the invention.

FIG. 2 provides an example block diagram of a power supply 4 according to an embodiment of the invention. The power supply 4 comprises a power source 21, a high voltage generator 22 with an output value, a monitoring circuit (voltage monitoring means) 23 adapted to monitor the current of a reference electrode 262 and the output voltage at a spray electrode 261, and a control circuit (control means) 24 adapted to control the high voltage generator 22 such that the output voltage of the high voltage generator 22 has a desired value. For many practical applications, the control circuit 24 may comprise a microprocessor 241, the microprocessor adapted to enable further adjustment of output voltage and spray time based on other feedback information 25 such as environmental condition (temperature, humidity and/or atmospheric pressure), liquid content, liquid level and optional user setting.

The Power source 21 is known in the art. The power source 21 includes a main power source or at least one battery. The power source 21 is a low voltage supply, and a direct current (DC) power source. For example, one or more voltaic cells may be combined to make a battery. A suitable battery includes one or more AA- or D-cell batteries. The number of batteries is determined by the required voltage level and consumption power of the power source. We have found that 2AA batteries supplying 3 V can provide sufficient voltage level for the microprocessor operation and can provide enough power to run the electrostatic atomizer at 0.8 uA spray current and 5.5 kV output voltage (typical values) for up to 2 months on a 12.5% spray duty cycle.

The high voltage generator 22 typically comprises a self-oscillating circuit 221 which converts DC to AC, a transformer 222 that drives by AC, and a converter circuit 223 connected to the transformer 222. We have found that a very power efficient cost-effective transformer drive circuit is a current fed push-pull topology with current limit applied. The current limit of the drive circuit is provided in order to avoid transformer saturation. The converter circuit typically comprises a charge pump, and a rectifier circuit. The converter circuit generates the desired voltage and converts AC back into DC. A typical converter circuit is a Cockcroft-Walton generator.

The monitoring circuit 23 comprises a current feedback circuit 231, and may also comprise a voltage feedback circuit 232 depending on the application. The current feedback circuit 231 measures the electrical current at the reference electrode 262. Because the electrostatic atomizer is charge balanced, referential measuring of this current provides an accurate monitor of the current at the electrostatic spray site 5. Such a method eliminates the necessities that (i) expensive, complex or disruptive measuring means is provided at the electrostatic spray site 5 and (ii) the contribution of a discharge current to measured current is estimated. The current feedback circuit 231 may comprise any conventional current measurement apparatus, for example, a current transformer.

In a preferred embodiment, the current at the reference electrode is measured by measuring the voltage across a set resistor (feedback resistor) which is in series with the reference electrode. In an embodiment, the voltage measured across the set resistor is read using an analogue to digital (A/D) convertor, which is typically part of the microprocessor. A suitable microprocessor with an A/D converter is a microprocessor of the PIC16F18 family produced by Microchip. The digital information is processed by the microprocessor to provide an output for the control circuit 24**.

A disadvantage of the A/D converter circuit is that A/D conversion may introduce delay in the control response due to A/D conversion time. In addition, often the current level of the electrostatic atomization process is very low (a few microamperes) and further amplification of the current is necessary in order to supply sufficient current for the A/D conversion. This may be achieved by the use of an operational amplifier, which can increase cost and total consumption current of the power supply.

In a preferred embodiment, the voltage measured across the set resistor is compared against a predetermined constant reference voltage level by using a comparator. Comparators require very low current input (typically nanoampere or less) and fast response and often microprocessor provide in built comparators for such purpose. For example, PIC16F1824 of the above mentioned microchip family provides a suitable comparator with very low current input and constant reference voltage. The reference voltage level to the comparator may be set by use of D/A converter also comprised in this microprocessor, providing 32 selectable reference voltage levels. In typical operation, this circuit is able to detect whether the measured current is below or above a requested level determined by the magnitude of reference voltage and feedback resistor and feed the information to the control circuit.

In applications where the knowledge of precise voltage value is required, the monitoring circuit 23 also comprises a voltage feedback circuit 232, measuring the applied voltage to the spray electrode 261. Typically, the applied voltage is directly monitored by measuring the voltage at the junction of two resistors forming a potential divider connected between the first and second electrodes. Alternatively, the applied voltage may be monitored by measuring the voltage developed at a node within the Cockcroft-Walton generator using the same potential divider principle. Similarly, as for current feedback, the feedback information may be processed either via an A/D converter or by comparing the feedback signal against a reference voltage value using a comparator.

The control circuit 24 controls the output voltage of the high voltage generator 22 by controlling a magnitude, a frequency, or a duty cycle of oscillation in the oscillator 211, or on/off time of a voltage (or combinations of these). In this example, the control circuit 24 controls the output voltage of the high voltage generator 22 by directing the oscillator 221 to produce bursts of alternating current at a predetermined frequency whereby the duration and/or duty cycle of the bursts of alternating current determine the output voltage. The control circuit 24 receives a signal indicating the monitored current of the electrostatic spray site 5 as an output from a comparator and adjusts the duration and/or the duty cycle of the bursts of AC to vary the value of the output of the high voltage generator to a desired value in accordance with a predetermined characteristic. The control circuit 24 may be adapted to use a pulse width modulation (PWM) scheme (use a pulse-width modulated signal) in order to provide an adjustable limit for the output voltage of the high voltage generator by setting a limit value for the PWM duty cycle. Typically, the control circuit 24 is an output port of the microprocessor 241, capable of providing a PWM signal. The spray duty cycle and spray period may also be controlled via the same PWM output port. During atomization, the PWM signal is applied. The voltage can be adjusted either by changing the duty cycle of the PWM signal or by turning the PWM signal rapidly ON and OFF based on the feedback information. The firmware implementation of the control circuit 24 depends on the required compensation scheme. For example, a simple feedback control, where the output voltage needs to be adjusted in order to keep the spray current constant, can be realized just by configuring auto-shutdown and auto-restart of the PWM signal based on the comparator output of the current feedback. This type of configuration is provided in the above-mentioned PIC16F1824 microcontroller.

Where high-precision control of a minimum output voltage Vm of the high voltage generator is not required, the control circuit 24 may be adapted to set Vm, for example by monitoring the power supplied to the high voltage generator 22 by measuring the current supplied to the high voltage generator 22. Advantageously, by controlling voltage in this way, the average duration of a burst of AC can be employed as an indicator of power consumption by the high voltage generator 22. For example, a 10% decrease in power consumption can be taken to represent a 10% decrease in the resistance between the spray electrode 261 and the reference electrode 262, which can be compensated by increasing the feedback current by approximately 10% so as to sustain the output of the high voltage generator 22 at a desired level. A minimum voltage limit for Vm can therefore be provided without the necessity of monitoring the output voltage of the high voltage generator 22, which would otherwise require costly components and/or additional power consumption. The disadvantage of the power consumption measurement is that its precision is affected by the power losses in the high voltage circuit.

Further, inputs 25 to the microprocessor 241 can be provided based on the necessity of voltage or duty cycle/spray period compensation based on ambient temperature, humidity, atmospheric pressure, liquid content of matter to be atomized, and liquid level of the matter to be atomized. The information can be provided in form of analogue or digital information, and is processed by the microprocessor. Typically, A/D conversion is provided for the analogue signal and communication port depending on the data type (e.g. I2C) is provided for the digital information. The microprocessor can provide compensation in order to provide spray quality and stability based on the input information using a predetermined scheme via the above-mentioned PWM output port either by altering the spray period, spray on time or applied voltage.

As an example, the power supply may comprise a temperature-sensing element (a temperature sensor), such as a thermistor used for temperature compensation. In an embodiment, the power supply is adapted to vary the spray period according to variation in temperature sensed by the temperature-sensing element. The spray period is the sum of the on and off times of the power supply. For example, in a case of a periodical spray period, in which the power supply is turned on for a cyclical spray period of 35 seconds (during which time the power supply applies a high voltage between the first and second electrodes) and is turned off for 145 seconds (during which time the power supply does not apply high voltage as above), the spray period is 35+145=180 seconds. The spray period may be varied by software built in the microprocessor of the power supply such that the spray period is increased as temperature increases and the spray period is decreased as temperature decreases from a set point. Preferably, the increase and decrease in spray period is in accordance with a predetermined characteristic which characteristic may be determined by the properties of the matter to be atomized. Conveniently, compensatory variation of spray period may be limited such that the spray period is only varied between 0-60 deg C. (e.g., 10-45 deg C.), thereby assuming that extreme temperatures registered by the temperature sensor element are faults and are discounted whilst still providing an acceptable albeit non-optimized spray period for low- and high-temperature conditions. Alternatively, the on- and off-times of the spray period may be adjusted so as to keep the spray period constant, but to increase or decrease the spray time within the period as temperature decreases or increases.

The power supply 4 can further include an inspection circuit for detecting a property of the matter to be atomized, and determining information relating to the property of the matter to be atomized. The information, relating to the property of the matter to be atomized, which has been determined by the inspection circuit is provided to the control circuit 24. The control circuit 24 utilizes the information to compensate at least one voltage control signal. The voltage control signal is a signal generated according to a result obtained by detection of ambient environmental conditions (such as temperature, humidity and/or atmospheric pressure, and/or spray content), and a signal for adjusting an output voltage or a spray period. The power supply 4 can include a pressure sensor for monitoring ambient pressure (atmospheric pressure).

In many applications, it is desirable to warn a user when the liquid reservoir is empty. A suitable warning may be in form of a visual signal such as LED or LCD screen, or an audio signal such as a buzzer or a speaker. Information on liquid level may be provided via the above-mentioned liquid level sensor. The inventors have found that a cost-effective solution is to use the existing current feedback information. When the liquid reservoir is empty, the electrostatic atomization process will stop and, consequently, the current will be reduced to zero. After detecting a zero current condition, the microprocessor may react based on a predetermined scheme, e.g. stop the high voltage signal and trigger a user warning as described above.

For example, the power supply can further include a monitoring circuit capable of monitoring a threshold of residual amount of the matter to be atomized in the liquid reservoir by measuring the current at the reference electrode 2.

Although such a scheme is simple and cost-effective, its usability depends on the environmental conditions and electrode configuration. The inventors have found that certain combination of electrode configuration (such as both electrodes with sharp edges creating strong electric field) and environmental conditions (such as high humidity) may lead to air ion production from both electrodes when liquid is not available for the electrostatic atomization process. Based on the charge balance principle, the system will produce the same amount of positive and negative air ions, and this will lead to the presence of electrical current in the feedback circuit. Consequently, the system will be unable to detect that the reservoir is empty. To overcome this issue, a secondary monitoring system may be introduced. A cost-effective secondary system includes a separate "monitoring" electrode, immersed in the liquid reservoir. The voltage level on the electrode is monitored e.g. by measuring the voltage at the junction of two resistors forming a potential divider connected between the monitoring electrode and the reference electrode, and the information is fed to and is processed by the microprocessor. When the monitoring electrode is immersed in the liquid, it will be on the same potential as the spray electrode. On the other hand, when the monitoring electrode is outside of the liquid, the potential will be lower, the actual value depending on the conductivity of the air inbetween the monitoring electrode and the liquid. Ideally, the tip of the monitoring electrode is a rounded shape and sufficiently small in size so as to reduce the effect of possible ion generation inducing instabilities on the system. As the potential divider circuitry may consume considerable power compared to the electrostatic atomization process, preferably, it is designed so that the monitoring electrode can be connected at the beginning of the spray process to confirm the level of liquid and then disconnected for the left spray time. Such connection is typically realized via a suitable relay.

Figure 3:
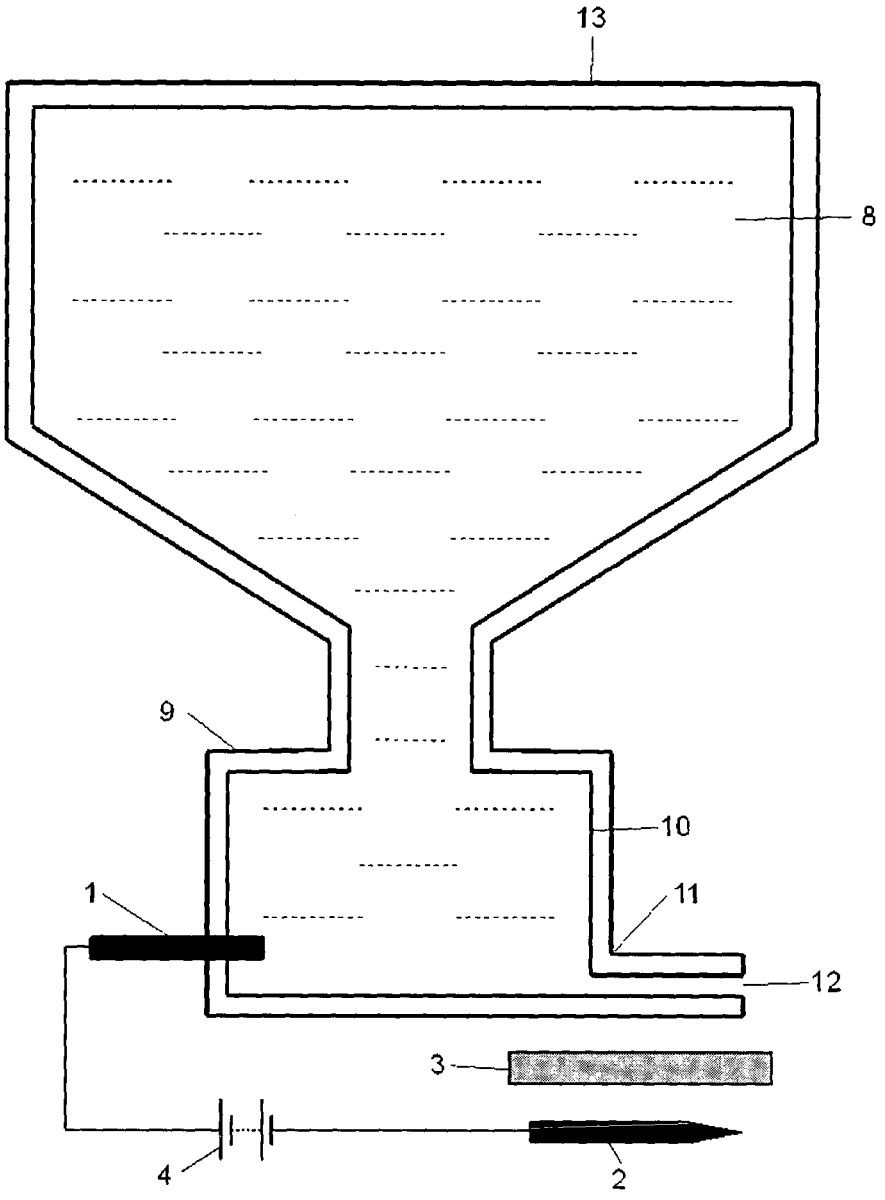
FIG. 3 shows an alternative example of the first electrode, second electrode, cavity and power supply according to an embodiment of the invention.

Conveniently, the monitoring electrode and the spray electrode may be coincident, as is described with reference to FIG. 3. That is, the spray electrode 1 can also serve as the monitoring electrode. FIG. 3 shows a second embodiment of an electrostatic atomizer according to the invention. The electrostatic atomizer comprises a first electrode 1 and a second electrode 2 which are conductive and insulated from each other insofar as there is no line-of-sight between any portion of the first electrode 1 and the second electrode 2. The first electrode 1 and the second electrode 2 are separated by a dielectric 3. Conveniently, at least one of the first electrode 1 and the second electrode 2 comprises a rod. Preferably, the second electrode 2 comprises a pin and is a pin electrode. In this example, the pin electrode is a sharp, stainless steel pin, such as a 304 stainless steel pin, 0.6 mm in diameter. The pin electrode is a reference electrode to the other of the first electrode 1 and the second electrode 2, which is a spray electrode. The spray electrode 1 electrically affects matter 8 to be atomized stored in a cavity 9. Where the matter 8 to be atomized is a liquid, the spray electrode 1 is electrically connected via the liquid to the cavity 9 storing the liquid.

In this embodiment, the spray electrode 1 is disposed within the cavity 9. The spray electrode 1 is a stainless steel pin, such as a 304 stainless steel pin, 0.6 mm diameter. Other materials and shapes of the spray electrode 1 are possible, provided that at least a conductive portion of the spray electrode 1 is located within the cavity 9. In this example, part of the spray electrode 1 is located within the cavity 9 such that the at least one exposed conductive portion of the spray electrode 1 is immersed in a liquid 8 to be atomized when the cavity 9 is filled with the liquid and the device is operational. The spray electrode 1 passes through a wall of the cavity 9 and a part of the spray electrode 1 outside the cavity 9 is conductively connected to a high voltage power supply 4. In this example, the part of the spray electrode 1 located in the cavity 9 comprises a sharp tip which protrudes into the volume of the cavity 9. Other geometries of the tip of the spray electrode located in the cavity 9 are possible, including a blunt tip which protrudes into the cavity 9 or a blunt tip which is flush with an internal wall 10 of the cavity 9. In one embodiment, the surface area of the at least one exposed conductive surface is greater than the diameter of the spray electrode, for example the conductive surface comprises a plate, the plate is conductively connected to the portion of the spray electrode passing through the wall of the cavity 9. Conveniently, the plate may be embedded in the internal wall 10 of the cavity 9. In another embodiment, the spray electrode can have a portion which is horizontally disposed along the internal wall 10 of the cavity 9. The portion further comprises at least one portion, preferably many portions, most preferably its entire cavity-facing surface, which is conductive and is exposed to the inner volume of the cavity 9. The portion so disposed may form a whole or partial band on the internal wall 10 of the cavity 9. In 2this way, the liquid 8 in the cavity 9 is exposed to a conductive portion of the spray electrode 1 when the cavity 9 of the electrostatic atomizer is not ideally placed to be upright, i.e., is at an angle.

In this embodiment, the cavity 9 can supply fluid outside the cavity 9 via an opening 11. The opening 11 has a size determined such that when not in use, any liquid in the cavity 9 which is communication with the opening 11 is retained in the opening 11 by the surface tension of the liquid. In this example, the opening 11 comprises a narrow conduit 12, such as a narrow nozzle. The narrow conduit 12 is molded from the same material as the cavity 9, for example from polypropylene, polyethylene terephthalate (PET) or other chemical-resistant materials. The opening 11 may take other forms, including as a short conduit or a capillary or an orifice. Preferably, the site from which liquid is atomized (the spray site) is collocated with the opening 11. Preferably, the spray site is separated from the reference electrode 2 by the dielectric 3. Particularly preferably, the spray site is also not in line-of-sight with the reference electrode 2.

The internal wall 10 of the cavity 9 do not require a particular treatment, however it may be desirable to treat the internal wall 10 of the cavity 9 with an oleophobic treatment if a substantially non-aqueous liquid is to be atomized, or an hydrophobic treatment if a substantially aqueous liquid is to be atomized. In such cases, the spray electrode 1 may also be treated provided that a conductive portion of the spray electrode 1 remains exposed.

Optionally, the cavity 9 is in fluid communication with a reservoir 13 such that, in use, the reservoir 13 empties into the cavity 9 as liquid is atomized from the electrostatic atomizer. For example, the reservoir 13 and the cavity 9 can be arranged such that matter left in the reservoir 13 is added into the cavity 9 by quantity of matter atomized at one electrostatic atomization. The cavity 9 may be an adaptation of the reservoir 13. As liquid is atomized from the electrostatic atomizer, unless the cavity 9 and the optionally provided reservoir 13 are directly open to the air, then a pump, collapsing reservoir (such as the collapsible reservoir of U.S. patent application Ser. No. 11/582,674), wick or air bleed system is required to compensate for the volume of liquid consumed and to avoid a vacuum force from preventing long-term atomizing of liquid from the device, e.g., for atomizing continuously for not less than 1 hour. Systems for replacing displaced volumes of liquid are known in the art.

As illustrated in FIG. 3, the reservoir 13 is located vertically above the cavity 9 in a case where a user keeps the electrostatic atomizer in use. Therefore, matter to be atomized moves from the reservoir 13 to cavity 9 by gravity during atomization.

The electrostatic atomizer can further include pump-feed means for feeding the matter to be atomized from the reservoir 13 to the cavity 9. The pump-feed means is preferably electrically powered, for example, an electric pump.

Figure 4:
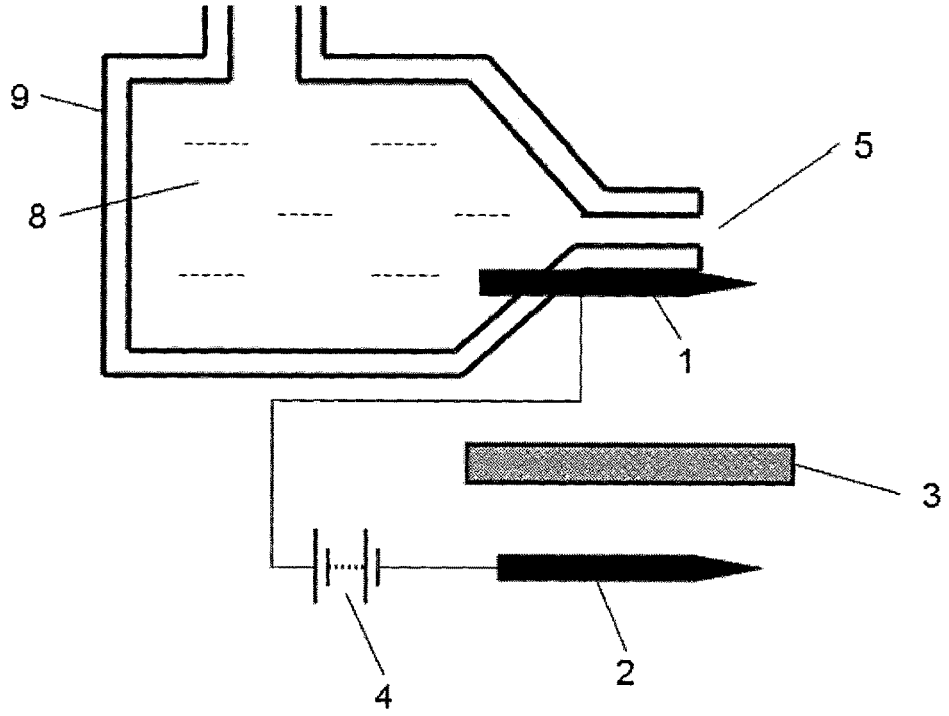
FIG. 4 shows another alternate example of the first electrode, second electrode, cavity and power supply according to an embodiment of the invention.

FIG. 4 shows a third embodiment of the invention. In the third embodiment, the first electrode 1 penetrates a wall of the cavity 9. The first electrode 1 has (i) at least one portion which is disposed within the cavity 9 and conductively exposed to the liquid 8 in the cavity 9, (ii) a portion which is disposed outside the cavity 9 and adjacent to the spray site 5, and (iii) a portion disposed outside the cavity 9 which is conductively connected to the power supply 4. The spray site 5 is characterized in that it is located at the external opening of the cavity 9. In this example, the opening of the cavity 9 is formed as an extrusion of the cavity 9. The first electrode 1 is a spray electrode, and the second electrode 2 is a reference electrode. The spray electrode 1 and the reference electrode 2 are such that they are insulated from each other i.e., that they are not in line-of-sight of each other.

Figure 5:
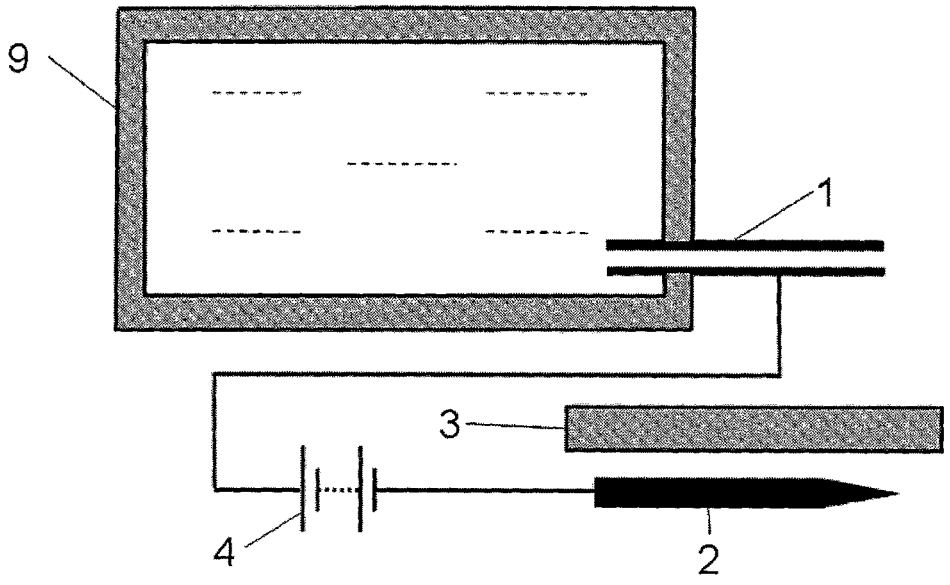
FIG. 5 shows another alternate example of an electrostatic atomizer according to an embodiment of the invention.

FIG. 5 shows a fourth embodiment of the electrostatic atomizer of the invention, and shows a spray electrode (a first electrode) 1, a reference electrode (a second electrode) 2, a cavity 9 and a power supply 4. In this example, the spray electrode 1 comprises a capillary. The capillary of the spray electrode 1 is conductive, and electrically affects, via a fluid (a liquid), matter to be atomized stored in the cavity 9. The capillary of the spray electrode 1 and the reference electrode 2 are conductively connected to the power supply 4.

The matter to be atomized is moved to the tip of the capillary (the spray site 5) by a capillary phenomenon, and electrostatically atomized from the tip in the same manner with the above-described principle.

Figure 6:
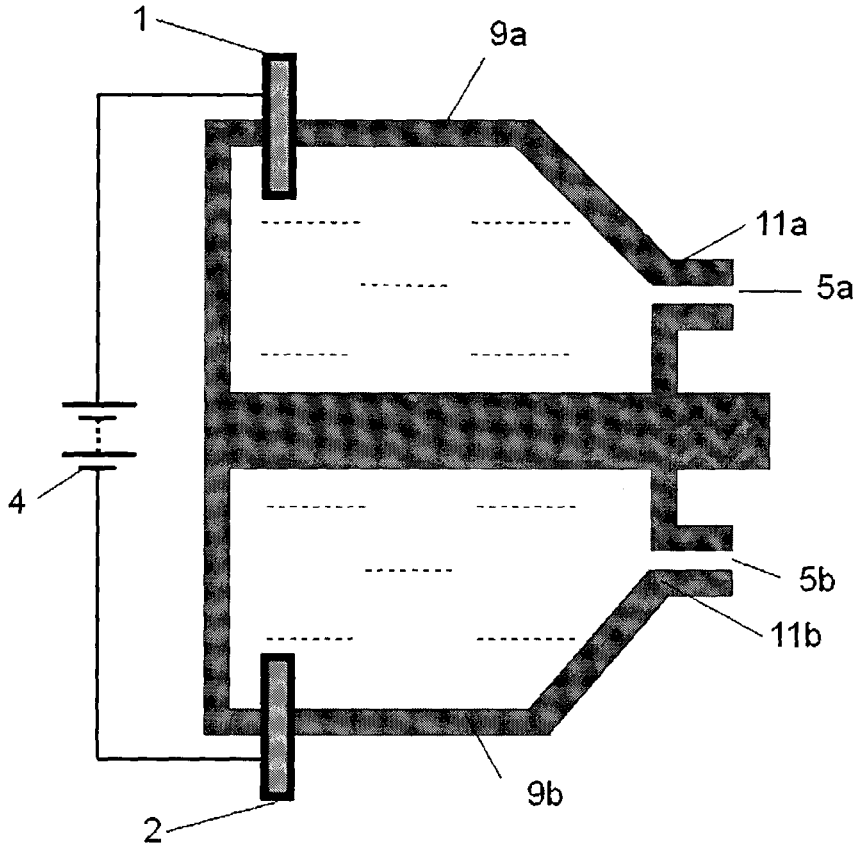
FIG. 6 shows an alternative electrostatic atomizer according to an embodiment of the invention, comprising two cavities, two electrodes and two spray sites, wherein the spray electrode for one spray site is also the reference electrode for the other spray site and vice-versa.

FIG. 6 shows a fifth embodiment of the electrostatic atomizer of the invention. In this embodiment, the first electrode 1 is in communication with a first cavity (a first reservoir) 9*a*, and the second electrode 2 is in communication with a second cavity (a second reservoir) 9*b*. The first electrode 1 and the second electrode 2 were conductively connected to the power supply 4. The first cavity 9*a* comprises an opening 11*a* comprising a conduit having an outer end portion. The conduit of the first cavity 9*a* comprises a spray site 5*a* (a first spray site). The second cavity 9*b* similarly comprises an opening 11*b* comprising a conduit having an outer end portion. The conduit of the second cavity 9*b* comprises a spray site 5*b* (a second spray site). In use (during atomization), either the first cavity 9*a* or the second cavity 9*b* stores matter (first matter) to be atomized, although both the first cavity 9*a* and the second cavity 9*b* may store the same or different matter (second matter) to be atomized. Preferably, at least one of the first cavity 9*a* and the second cavity 9*b* stores a liquid as the matter to be atomized.

That is, the first electrode 1 is electrically connected to the first spray site 5*a* via the matter (liquid) to be atomized, which matter is stored in the first cavity (first reservoir) 9*a*, and the first electrode 1 and the first spray site 5*a* electrically affect the matter to be atomized. Similarly, the second electrode 2 is electrically connected to the second spray site 5*b* via the second matter to be atomized, which second matter is stored in the second cavity (second reservoir) 9*b*, and the second electrode 2 and the second spray site 5*b* electrically affect the second matter to be atomized.

A charge-balanced device according to FIG. 6, measures an electrical property of either the first electrode 1 or the second electrode 2, and monitors either the spray site 5*a* or the spray site 5*b*. For example, the current at either the first electrode 1 or the second electrode 2 may be measured, and the spray current at either the spray site 5*a* or the spray site 5*b* is monitored. In practice, however, the current at the first electrode 1 and the second electrode 2, which is at the potential closest to the ground of the power supply of the microprocessor, is measured. In this way, noise in measurement of a low current on a high voltage signal would be avoided.

The first electrode 1 and the second electrode 2 can be electrically biased by a single power source.

The inventors have successfully atomized the French Lavender fragrance formulation of Atrium Innovation Ltd (Pipe House, Lupton Road, Wallingford, United Kingdom) for a period of 30 days, with the electrostatic atomizer according to the invention configured to provide a high voltage of approximately 5.2 kV+/−0.2 kV between the first electrode 1 and the second electrode 2 according to a 12.5% duty cycle of ON/OFF time. It will be appreciated that other values may be utilized to perform electrostatic atomization with a device according to embodiments of the present invention where the utilized values will depend on, for example, environmental factors, the device configuration, and the matter to be atomized. Other suitable liquids include liquids adapted to have at 20° C. a resistivity in the range of $1\times10^3$ through $1\times10^6$ Ω·m, and a surface tension in the range 20 through 40 $mN\cdot m^{-1}$.

The matter to be atomized may comprise an active ingredient, such as a fragrance, an insecticide, a medicament or a combination of these active ingredients.

Note that the present invention can be described as below. That is, an electrospray device of the present invention includes: a spray site from which matter is to be sprayed arranged, in use, in communication with matter for electrospray; a spray electrode in communication with the spray site, and a reference electrode arranged so that when a voltage is applied between the spray electrode and the reference electrode the matter for electrospray is sprayed from the spray site; and a power supply operable to: apply a voltage between the spray electrode and the reference electrode; monitor an electrical property of the spray site; and to adjust the voltage applied between the spray electrode and the reference electrode according to the monitored electrical property of the spray site and a predetermined characteristic; wherein the spray electrode and the reference electrode are further arranged so that electrical charge of matter sprayed from the spray site is counterbalanced by the production of at least an equal amount of opposite electrical charge at the reference electrode.

The electrospray device of the present invention further includes: a second spray site for spraying matter having charge of an opposite polarity to that of matter sprayed at the first spray site; and the reference electrode is a further electrode in communication with the second spray site;

wherein the first spray site is charged by the spray electrode to a first polarity and the second spray site is charged by the further electrode to an opposite polarity to the first polarity and the spray electrode and further electrode are electrically biased by a single power source.

The electrospray device of the present invention further includes: a second spray site from which further matter is to be sprayed arranged, in use, to be in communication with further matter to be sprayed, wherein the reference electrode is arranged to be in communication with the second spray site and so that when a voltage is applied between the reference electrode and the spray electrode, in use, matter is sprayed from the first spray site and the further matter is sprayed from the second spray site.

The electrospray device of the present invention further includes a first reservoir containing the matter to be sprayed and a second reservoir containing the further matter to be sprayed; wherein the spray electrode and the spray site are in fluid communication with the matter to be sprayed contained in the first reservoir and the reference electrode and the second spray site are in fluid communication with the further matter to be sprayed contained in the second reservoir.

The electrospray device of the present invention includes: a first spray site and a second spray site from which matter is to be sprayed arranged, in use, to be in communication with matter for electrospray contained in respective first and second containers; a first electrode in communication with the first spray site and a second electrode in communication with the second spray site arranged so that when a voltage is applied between the first and second electrode the matter for electrospray in the first container is sprayed from the first spray site and the matter for electrospray in the second container is sprayed from the second spray site; and a power supply operable to: apply a voltage between the first electrode and the second electrode; wherein the first electrode and second electrode are arranged so that electrical charge of matter sprayed from the first or second spray sites is counterbalanced by the production of at least an equal amount of opposite electrical charge at the first or second spray site respectively.

Some embodiments of the present invention disclose an electrostatic atomizer in which, preferably, the power supply is operable to monitor the current at the spray site by measuring the electrical current at the reference electrode. In an embodiment, the power supply is operable to measure the electrical current at the reference electrode by means of a current transformer. In a further embodiment, the power supply is operable to measure the current at the reference electrode by measuring the voltage across a resistor connected in series with the reference electrode.

Preferably, the power supply includes (i) a main power supply or (ii) a power supply including one or more batteries, from which a voltage is to be applied.

Further, it is preferable that the power supply further comprises a high voltage generator for providing the voltage to be applied by the power supply between the spray electrode and the reference electrode. In an embodiment, the high voltage generator comprises an oscillator, a converter and a rectifier circuit. In a further embodiment, the power supply further comprises control means for controlling a magnitude, a frequency or a duty cycle of oscillation in the oscillator circuit so as to adjust a voltage to be applied.

Some embodiments of the present invention disclose an electrostatic atomizer in which, the power supply causes the oscillator circuit to produce bursts of alternating current at a predetermined frequency so as to adjust the voltage to be applied, and duration and/or the duty cycle of the bursts of alternating current determine(s) a value of the voltage to be applied. Preferably, duration for which bursts are applied is controlled by using a pulse-width modulated signal provided by a microprocessor, the microprocessor measuring current and a voltage via an analog to digital converter. In this way, the predetermined output voltage response to the feedback information may be part of the microprocessor firmware, and can easily be changed, if necessary, without changes to the power supply circuit hardware.

Some embodiments of the present invention disclose an electrostatic atomizer in which, the electrostatic atomizer further comprises directing means for directing the matter to be atomized from the spray site away from the electrostatic atomizer such that at least a part of charged particles do not reach the reference electrode. Preferably, the directing means comprises a dielectric arranged near the spray site so that, during atomization, an electrical charge having a polarity identical to that of the matter to be atomized is accumulated on a side of the dielectric, which side is proximate to the spray site, and the electrical charge directs the matter to be atomized from the spray site away from the electrostatic atomizer. Preferably, the dielectric is arranged between the spray electrode and the reference electrode. In an embodiment, the dielectric is further arranged so as to block a line segment between the spray site and the reference electrode.

Thus, in embodiments of the invention, modification of the shape of the electric field created between the first electrode and the second electrode may be achieved using dielectric material around and in particular in between the first electrode and the second electrode. The dielectric material will attract charged particles, which, in turn, change the electric field present between the first electrode and the second electrode. In a particularly desired arrangement of electrodes and dielectric, the electric field is shaped in order to produce a strong force exerted on the charged droplets in the direction parallel to the spray electrode (i.e. away from the electrostatic atomizer). Ideally, momentum gained by charged matter atomized from the electrostatic atomizer by electrostatic atomization will be sufficient to overcome an attractive force towards the reference electrode and a stable stream of electrostatically atomized charged particles is obtained.

Although the above-mentioned usage of dielectric material has been found to be the most cost-effective way to produce a stream of charged particles directed away from the electrostatic atomizer, other means may also be used. In an embodiment, a magnetic field is applied to deflect the motion of charged particles, and produce charged particle stream in the desired direction. For example, a magnet is appropriately arranged near the spray electrode so as to direct charged particles away from the electrostatic atomizer. In another embodiment, an air stream (e.g. created by a fan) is used to achieve the same effect. In yet another embodiment, a suitable combination of the above techniques is used to achieve the most optimal spray performance. For example, such an air stream generator is arranged along the spray electrode so as to direct the charged particles away from the electrostatic atomizer.

Thus, in a further embodiment, the directing means comprises a magnetic field generator for generating a magnetic field having suitable properties to deflect a motion of charged matter atomized from the spray site.

Some embodiments of the present invention disclose an electrostatic atomizer in which, the directing means comprises air stream generation means for generating an air stream to deflect a motion of charged matter atomized from the spray site.

Some embodiments of the present invention disclose an electrostatic atomizer in which, the power supply periodically changes a polarity of the voltage to be applied between the spray electrode and the reference electrode such that matter having a positive electrical charge, and matter having a negative electrical charge are alternately atomized from the spray site. For example, such a change in polarity of the electrodes can be attained by use of an appropriate high voltage generator capable of generating a high voltage having a positive polarity and a high voltage having a negative polarity.

Some embodiments of the present invention disclose an electrostatic atomizer in which, the matter to be atomized is a liquid, and the spray site is configured to have such a dimension that when there is no voltage applied between the spray electrode and the reference electrode, at least a part of the matter to be atomized is retained at the spray site by surface tension of the liquid.

Some embodiments of the present invention disclose an electrostatic atomizer in which, the spray electrode is not located at and adjacent to the spray site. For example, in an embodiment, the electrostatic atomizer further comprises a cavity for holding the matter to be atomized, wherein the spray electrode is arranged so that it is at least partially located within the cavity. Preferably, the spray site is an extrusion of the cavity, and the extrusion comprises a capillary, a nozzle, or a conduit comprising an opening. In an embodiment, the spray electrode is electrically connected to the spray site via the matter to be atomized.

Some embodiments of the present invention disclose an electrostatic atomizer in which, the spray electrode is electrically connected to the spray site by being located at or adjacent to the spray site. In an embodiment, the spray electrode comprises a conduit having an outer end portion, and the spray site comprises a tip on the outer end portion. Preferably, the conduit is in communication with a cavity, the cavity is arranged so as to be in communication with a reservoir from which, during atomization, the matter to be atomized is passed to the cavity. Preferably, the reservoir is arranged such that, during atomization, the matter to be atomized is passed to the cavity by gravity. For example, the reservoir is provided above the cavity, and a flow path is formed between the reservoir and the cavity. In an embodiment, the reservoir and the cavity are arranged such that a volume of matter atomized in a single actuation of the electrostatic atomization are replaced in the cavity by matter remaining in the reservoir. In another embodiment, the electrostatic atomizer further comprises pump-feed means, which is preferably electrically powered, for feeding the matter to be atomized from the reservoir to the cavity. For example, a pump is provided between the reservoir and the cavity.

Some embodiments of the present invention disclose an electrostatic atomizer in which, the power supply further comprises voltage monitoring means for monitoring the voltage to be applied between the spray electrode and the reference electrode. In an embodiment, the electrostatic atomizer further comprises two resistors, forming a potential divider, which are connected between the spray electrode and the reference electrode, wherein the voltage monitoring means measures a voltage at a junction of the two resistors. In a further embodiment, the power supply further comprises a high voltage generator for applying a voltage between the spray electrode and the reference electrode, and the voltage monitoring means measures a voltage developed at a node within a high voltage generator circuit. In another embodiment, the voltage monitoring means indirectly monitors the voltage by monitoring spray current at the spray site together with data on power consumption from a high voltage generator circuit. This embodiment is particularly suitable for low-cost applications. The output voltage is indirectly monitored using spray current feedback information together with the information on power consumption in the high voltage generator circuit. However, indirect monitoring of output voltage may introduce substantial inaccuracy, and is therefore useful if the precise value of high voltage output is not critical.

Some embodiments of the present invention disclose an electrostatic atomizer in which, the power supply further comprises a control circuit, the control circuit includes a microprocessor for providing at least one voltage control signal, the voltage control signal determines a characteristic of the voltage to be applied by the power supply between the spray electrode and the reference electrode, and the microprocessor provides the voltage control signal by processing a value of current or a voltage monitored by the power supply. In an embodiment, the control circuit is adapted to compensate at least the one voltage control signal for ambient environmental conditions including temperature, humidity and/or atmospheric pressure, and/or spray content. In an embodiment, the power supply further comprises a temperature sensor for monitoring ambient temperature, and information on the ambient temperature is provided to the control circuit, and utilized to compensate at least the one voltage control signal. In another embodiment, the power supply further comprises a humidity sensor for monitoring ambient humidity, and information on the ambient humidity is provided to the control circuit, and utilized to compensate at least the one voltage control signal. In a further embodiment, the power supply further comprises a pressure sensor for monitoring ambient pressure, and information on the ambient pressure is provided to the control circuit, and utilized to compensate at least the one voltage control signal.

Typically, an inspection circuit is constituted by an electrical identifier, such as an RF tag, a non-volatile memory (NVM) or a microprocessor, which detects an identifier by use of, for example, (i) an RFID circuit for an RF tag or (ii) a circuit such as a transmission protocol that reads a non-volatile memory (NVM). It is preferable that the electrical identifier is connected to the cavity, or the reservoir storing a liquid, and provided in a sufficient vicinity of a suitable circuit, and can be detected and identified by the suitable circuit. In this case, the suitable circuit can transmit the identity of the electrical identifier, and therefore can transmit, to the control circuit of the power supply, information on the matter to be atomized.

Some embodiments of the present invention disclose an electrostatic atomizer in which, the power supply further comprises an inspection circuit for detecting a property of the matter to be atomized, and determining information relating to the property of the matter to be atomized, and the information, relating to the property of the matter to be atomized, which has been determined is provided to the control circuit, and utilized to compensate at least the one voltage control signal.

Preferably, the control circuit is operable to provide compensation by altering any one or a combination of a period, a duty cycle, an amplitude, or an on-off time of the voltage to be applied by the power supply.

The control circuit is therefore advantageous because it is able to process environmental feedback signals and provide compensation based on a predetermined characteristic, in order to provide a stabilized flow rate of charged species. Preferably, a microprocessor will process input information, and provide compensation based on a predetermined characteristic, in order to provide stable quantity of charged species. The compensation can thus be performed by adjusting an output voltage, adjusting a spray period and a duty cycle, or a combination thereof. In a preferred embodiment, the predetermined characteristic is a part of firmware of the microprocessor, and adjustment is performed via an output port of the above-mentioned microprocessor. Adjusting the period and the pulse-width modulated signal will modify the output voltage. On the other hand, adjusting the ON-OFF time of the pulse-width modulated signal will modify the spray period and the duty cycle.

Some embodiments of the present invention disclose an electrostatic atomizer in which, the power supply further comprises a monitoring circuit capable of monitoring a threshold of residual amount of the matter to be atomized by measuring the current at the reference electrode. Current of electrostatic atomization is monitored by, for example, monitoring reduction in current when residual matter to be electrostatically atomized becomes below a threshold. According to the present invention, the microprocessor can respond by use of a current feedback circuit.

Some embodiments of the present invention disclose an electrostatic atomizer in which, the electrostatic atomizer further comprises a second spray site for atomizing matter having an electrical charge having a polarity opposite to that of matter to be atomized from the first spray site, the reference electrode being electrically connected to the second spray site, the first spray site being charged by the spray electrode to a first polarity, and the second spray site being charged by the reference electrode to a polarity opposite to the first polarity, and the spray electrode and the reference electrode being electrically biased by a single power source.

Some embodiments of the present invention disclose an electrostatic atomizer in which, the electrostatic atomizer further comprises a second spray site for electrostatically atomizing second matter to be electrostatically atomized by electrically affecting the second matter, wherein the reference electrode is arranged to be electrically connectable to the second spray site so that, during atomization, when a voltage is applied between the reference electrode and the spray electrode, matter is atomized from the first spray site, and the second matter is atomized from the second spray site.

The electrostatic atomizer further comprises: a first reservoir for storing the matter to be atomized; and a second reservoir for storing the second matter to be atomized, wherein the spray electrode and the spray site electrically affects, via a fluid, the matter to be atomized stored in the first reservoir, and the reference electrode and the second spray site electrically affects, via a fluid, the second matter to be atomized stored in the second reservoir.

In a further aspect of the present invention, there is provided a method of performing electrostatic atomization by use of an electrostatic atomizer comprising monitoring an electrical property of a spray site; and adjusting a voltage to be applied between a spray electrode or a first electrode and a reference electrode or a second electrode.

The invention being thus described, it will be obvious that the same way may be varied in many ways. Such variations are not to be regarded as a departure from the spirit and scope of the invention, and all such modifications as would be obvious to one skilled in the art are intended to be included within the scope of the following claims.

The invention claimed is:

1. A method of performing electrostatic atomization by use of an electrostatic atomizer comprising:

atomizing matter having at 20° C. a resistivity in the range of $1\times10^3$ through $1\times10^6$ Ω·m, and a surface tension in the range 20 through 40 $mN\cdot m^{-1}$;

monitoring a current of a spray site by measuring current only at a reference electrode; and adjusting a voltage to be applied between a spray electrode and a reference electrode, wherein the electrostatic atomizer comprises the spray site for electrostatically atomizing matter by electrically affecting the matter;

the spray electrode electrically connectable to the spray site; the reference electrode being arranged such that when a voltage is applied between the spray electrode and the reference electrode, the matter to be electrostatically atomized is atomized from the spray site; and a power supply applying a voltage between the spray electrode and the reference electrode, monitoring an electrical property of the spray site, and adjusting the voltage to be applied between the spray electrode and the reference electrode according to a monitored electrical property of the spray site, wherein the spray electrode and the reference electrode are further arranged that an electrical charge of the matter to be atomized from the spray site is counterbalanced by at least equal amount of opposite electrical charge at the reference electrode.

2. The method of claim 1, wherein the electrostatic atomizer further comprises a directing means for directing the matter to be atomized from the spray site away from the electrostatic atomizer such that at least a part of charged particles do not reach the reference electrode.

3. The method of claim 2, wherein the directing means comprises a dielectric arranged near the spray site so that, during atomization, an electrical charge having a polarity identical to that of the matter to be atomized is accumulated on a side of the dielectric, which side is proximate to the spray site, and the electrical charge directs the matter to be atomized from the spray site away from the electrostatic atomizer, and the dielectric is arranged between the spray electrode and the reference electrode.

4. The method of claim 1, wherein the power supply further comprises a control circuit, the control circuit includes a microprocessor for providing at least one voltage control signal, the voltage control signal determines a characteristic of the voltage to be applied by the power supply between the spray electrode and the reference electrode, the microprocessor provides the voltage control signal by processing a value of current or a voltage monitored by the power supply, wherein the control circuit is adapted to compensate at least the one voltage control signal for ambient environmental conditions including temperature, humidity and/or atmospheric pressure, and/or spray content, and the control circuit is capable of providing compensation by altering any one or a combination of a period, a duty cycle, an amplitude, or an on-off time of the voltage to be applied by the power supply.

5. The method of claim 1, wherein the electrostatic atomizer further comprises:

a second spray site for atomizing matter having an electrical charge having a polarity opposite to that of matter to be atomized from the first spray site, the reference electrode being electrically connected to the second spray site, the first spray site being charged by the spray electrode to a first polarity, and the second spray site being charged by the reference electrode to a polarity opposite to the first polarity, and the spray electrode and the reference electrode being electrically biased by a single power source.

6. The method of claim 1, wherein the electrostatic atomizer further comprises:

a second spray site for electrostatically atomizing second matter to be electrostatically atomized by electrically affecting the second matter, wherein the reference electrode is arranged to be electrically connectable to the second spray site so that, during atomization, when a voltage is applied between the reference electrode and the spray electrode, matter is atomized from the first spray site, and the second matter is atomized from the second spray site.

7. The method of claim 2, wherein the power supply further comprises a control circuit, the control circuit includes a microprocessor for providing at least one voltage control signal, the voltage control signal determines a characteristic of the voltage to be applied by the power supply between the spray electrode and the reference electrode, the microprocessor provides the voltage control signal by processing a value of current or a voltage monitored by the power supply, wherein the control circuit is adapted to compensate at least the one voltage control signal for ambient environmental conditions including temperature, humidity and/or atmospheric pressure, and/or spray content, and the control circuit is capable of providing compensation by altering any one or a combination of a period, a duty cycle, an amplitude, or an on-off time of the voltage to be applied by the power supply.

8. The method of claim 3, wherein the power supply further comprises a control circuit, the control circuit includes a microprocessor for providing at least one voltage control signal, the voltage control signal determines a characteristic of the voltage to be applied by the power supply between the spray electrode and the reference electrode, the microprocessor provides the voltage control signal by processing a value of current or a voltage monitored by the power supply, wherein the control circuit is adapted to compensate at least the one voltage control signal for ambient environmental conditions including temperature, humidity and/or atmospheric pressure, and/or spray content, and the control circuit is capable of providing compensation by altering any one or a combination of a period, a duty cycle, an amplitude, or an on-off time of the voltage to be applied by the power supply.

9. The method of claim 2, wherein the electrostatic atomizer further comprises:

a second spray site for atomizing matter having an electrical charge having a polarity opposite to that of matter to be atomized from the first spray site, the reference electrode being electrically connected to the second spray site, the first spray site being charged by the spray electrode to a first polarity, and the second spray site being charged by the reference electrode to a polarity opposite to the first polarity, and the spray electrode and the reference electrode being electrically biased by a single power source.

10. The method of claim 3, wherein the electrostatic atomizer further comprises:

a second spray site for atomizing matter having an electrical charge having a polarity opposite to that of matter to be atomized from the first spray site, the reference electrode being electrically connected to the second spray site, the first spray site being charged by the spray electrode to a first polarity, and the second spray site being charged by the reference electrode to a polarity opposite to the first polarity, and the spray electrode and the reference electrode being electrically biased by a single power source.

11. The method of claim 2, wherein the electrostatic atomizer further comprises:

a second spray site for electrostatically atomizing second matter to be electrostatically atomized by electrically affecting the second matter, wherein the reference electrode is arranged to be electrically connectable to the second spray site so that, during atomization, when a voltage is applied between the reference electrode and the spray electrode, matter is atomized from the first spray site, and the second matter is atomized from the second spray site.

12. The method of claim 3, wherein the electrostatic atomizer further comprises:

a second spray site for electrostatically atomizing second matter to be electrostatically atomized by electrically affecting the second matter, wherein the reference electrode is arranged to be electrically connectable to the second spray site so that, during atomization, when a voltage is applied between the reference electrode and the spray electrode, matter is atomized from the first spray site, and the second matter is atomized from the second spray site.

* * * * *